United States Patent [19]

Rauchi et al.

[11] Patent Number: 4,936,183

[45] Date of Patent: Jun. 26, 1990

[54] AUTOMATIC ACCOMPANIMENT SYSTEM WITH MUSICAL BREAKS

[75] Inventors: Francesco Rauchi, San Benedetto del Tronto; Luigi Bruti, Pedaso, both of Italy

[73] Assignee: Roland Corporation, Osaka, Japan

[21] Appl. No.: 289,544

[22] Filed: Dec. 23, 1988

[51] Int. Cl.[5] ..... G10H 1/02; G10H 1/36; G10H 7/00

[52] U.S. Cl. ..... 84/610; 84/631; 84/DIG. 4

[58] Field of Search ..... 84/1.03, 1.24, DIG. 4, 84/DIG. 12, 609–614, 631

[56] References Cited

U.S. PATENT DOCUMENTS 3,764,722 10/1973 Southard ..... 84/1.03

3,978,755 9/1976 Woron ..... 84/1.24

4,089,245 5/1978 Dietrich ..... 84/1.03

4,433,601 2/1984 Hall et al. ..... 84/1.03

*Primary Examiner*—Stanley J. Witkowski

*Attorney, Agent, or Firm*—Jack Kail

[57] ABSTRACT

An electronic musical instrument includes first and second control switches for initiating chorus and verse break patterns in an automatic accompaniment arrangement. A chorus accompaniment pattern is automatically generated following the chorus break pattern and a verse accompaniment pattern is automatically generated following the verse break pattern, regardless of the pattern types generated prior to the breaks. The generation of breaks are inhibited during the last ¼ interval of a bar and during the generation of the introduction and ending portions of the accompaniment arrangement.

6 Claims, 4 Drawing Sheets

AUTOMATIC ACCOMPANIMENT SYSTEM WITH MUSICAL BREAKS

BACKGROUND OF THE INVENTION

The present invention relates generally to electronic musical instruments and particularly concerns improved automatic accompaniment systems for electronic musical instruments.

Electronic musical instruments, most notably of the keyboard variety, which are capable of automatically playing a musical pattern or rhythm to accompany a melody played by a performer are well known in the art. The automatic accompaniment can be created in a variety of different musical styles and the instrumentation, rhythm, and chord patterns can be changed by the performer to add variety to the accompaniment. U.S. Pat. No. 4,433,601 to Hall et al. is exemplary of an electronic keyboard musical instrument having such an automatic accompaniment capability.

To add further interest to the automatic accompaniment, various special effects may be provided, such as the interruption of a rhythm pattern to insert a rhythm break, for example, a drum roll or the like. In musical performances, this type of special effect is frequently used to provide a musical accent or transition between the different parts of a song. U.S. Pat. No. 3,764,722 to Southard discloses an electronic musical instrument capable of inserting such musical breaks (sometimes called fill patterns) in automatic rhythm patterns. In the Southard system, the break is initiated by the performer operating a push-button switch, with the original rhythm pattern starting again at the end of the break. That is, the same rhythm pattern is played after the break as was played before it. This characteristic of prior art systems imposes a limitation on the variety of musical patterns which can be achieved in the creation of automatic accompaniment arrangements, and is therefore considered undesirable.

It is therefore an object of the present invention to provide an improved automatic rhythm or accompaniment system for an electronic musical instrument.

It is a further object of the invention to provide for the insertion of musical break patterns in an automatic accompaniment arrangement in a manner more musically interesting than has heretofore been done.

It is yet another object of the invention to provide for the insertion of a musical break in a first automatic accompaniment pattern and subsequently resume playing a second different automatic accompaniment pattern following completion of the break.

It is still a further object of the invention to delay the playing of a musical break initiated near the end of a musical interval until the beginning of the next interval.

BRIEF DESCRIPTION OF THE DRAWINGS

These and other objects and advantages of the invention will be apparent on reading the following description in conjunction with the drawings, in which.

DESCRIPTION OF THE PREFERRED EMBODIMENTS

Figure 1:
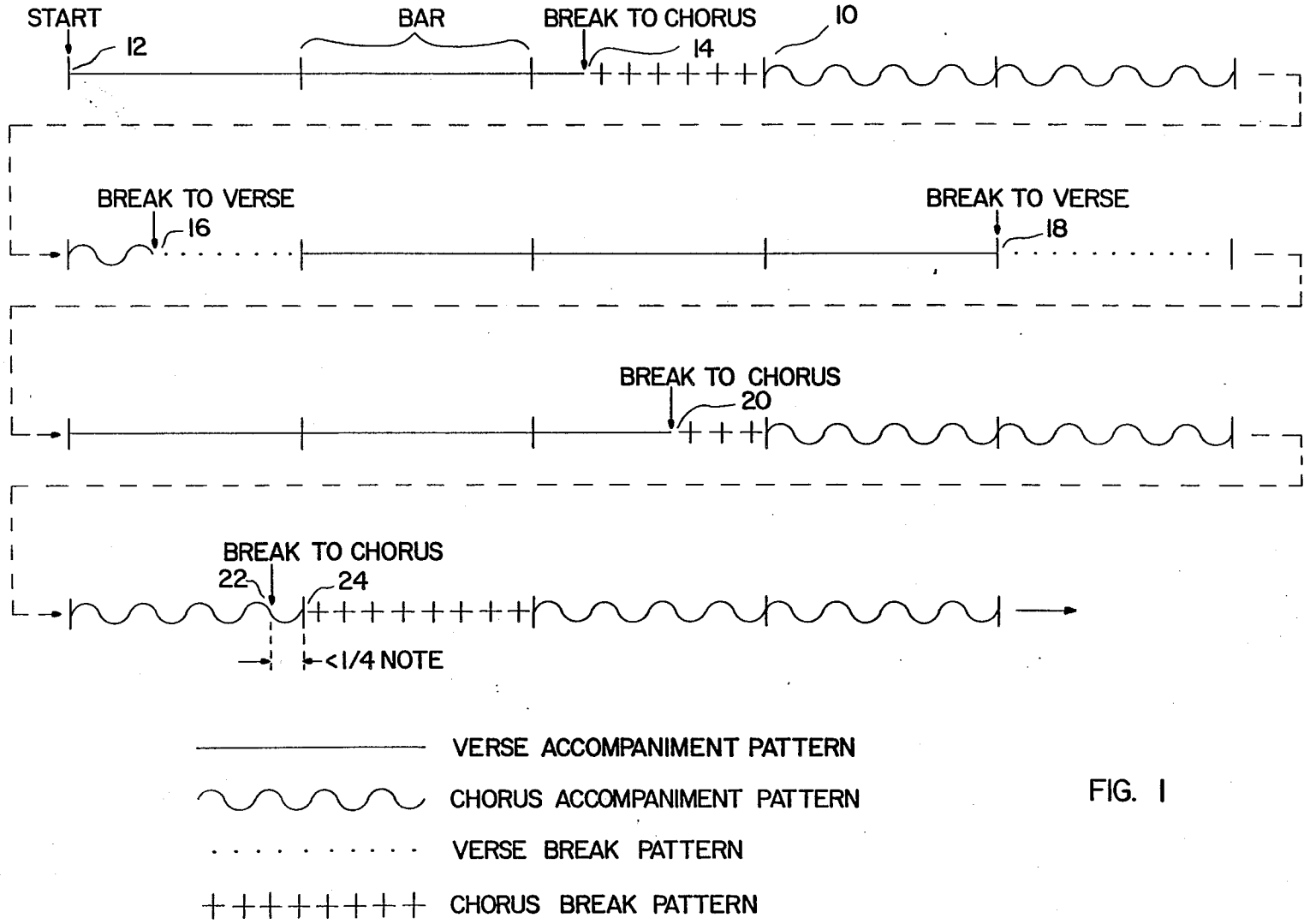
FIG. 1 is a time line representing the generation of an automatic accompaniment arrangement in accordance with the invention.

Referring to the drawings, FIG. 1 is a diagrammatic representation of the manner of operation of an electronic musical instrument in accordance with the invention. The diagram is in the form of a time line 10 comprising a plurality of musical bars or measures which represent a portion of a complete automatic accompaniment arrangement. The organization of a musical composition with which an automatic accompaniment may be desired is generally very well defined and typically includes an introduction, followed by a verse section (sometimes referred to as the first chorus), then a chorus section (sometimes referred to as the second chorus), which may then be followed by a repetition of any of the above before concluding with an ending. As indicated by the legend in the Figure, a solid line represents an automatic accompaniment pattern particularly suited for playing with the verse portion of a composition, a wavy line an automatic accompaniment pattern particularly suited for playing with the chorus pattern of the composition, a dotted line the playing of a verse break pattern and a series of addition signs the playing of a chorus break pattern. As mentioned previously, the break or fill patterns provide musical accents for transitions between the different parts of the accompaniment pattern.

With further reference to the time line 10, the exemplary automatic accompaniment arrangement begins at a start point 12 with two bars of a selected automatic accompaniment pattern suited for playing with the verse portion of a musical composition. The verse accompaniment pattern continues into the third bar where it is interrupted at a point 14 by a performer initiated "break to chorus" which may comprise, for example, a drum roll or the like. The break initiated at point 14 preferably comprises a variation of the accompaniment pattern and is referred as a "break to chorus" in that, following its completion at the end of the third bar, the automatic accompaniment resumes with a pattern suited for the chorus portion of the composition as shown. It should, in particular, be noted that in accordance with the invention the accompaniment pattern following the break pattern is different from the accompaniment pattern immediately preceding it.

Continuing along time line 10, the chorus accompaniment pattern following the break initiated at point 14 is played for the next two bars and into a third bar. A second break at a point 16, a "break to verse", is initiated by the performer in this bar,providing for the playing of a verse break pattern until the end of the bar. Since this break pattern leads into an automatic accompaniment pattern suited for playing with the verse portion of the composition, it is referred to as a "break to verse" pattern. It will, again be noted that the accompaniment patterns immediately preceding and following the break initiated at point 16 are different, with a chorus accompaniment pattern preceding the break and a different verse accompaniment pattern following it.

The verse accompaniment pattern is played for the next three bars until another "break to verse" is initiated by the performer at a point 18 coincident with the beginning of the next bar. This again interrupts the verse accompaniment pattern with a suitable verse break pattern which lasts for a complete bar. However, since the verse accompaniment pattern in this case was interrupted by a "break to verse" (in contrast to the "break to chorus" at point 14), the verse accompaniment pattern is resumed in the next bar following the break. The verse accompaniment pattern is played for two more bars and into a third bar when another "break to chorus" is initiated at a point 20 by the performer. As in the case of the "break to chorus" initiated at point 14, the verse accompaniment pattern is again interrupted and replaced with a suitable chorus break pattern, after which the chorus accompaniment pattern is resumed.

The initiation of a final "break to chorus" by the performer is illustrated as occurring at a point 22. It will be observed that this break is activated during the last ¼ interval of a bar. In a further aspect of the invention, if a break is initiated during a predetermined interval from the end of a bar, such as during the last ¼ of a bar as in the illustrated preferred embodiment, the change to the break pattern is delayed until the downbeat of the next bar to insure that the break is played even if keyed just slightly before the downbeat. Thus, the playing of the chorus break pattern is delayed until the downbeat of the next bar at point 24. The chorus break pattern is then played for the complete bar beginning at downbeat 24, after which the chorus pattern is resumed.

The verse and chorus break or fill patterns described above may be of a fixed nature or may be based on a sequential or random selection from groups of stored patterns. Thus, the precise nature of these patterns should not be considered as a limitation of the invention. Also, it will be understood that the musical arrangement represented by time line 10 is only exemplary of many automatic accompaniment arrangements which may be played in accordance with the invention. Finally, since time line 10 only represents a portion of an automatic accompaniment arrangement, the introduction and ending portions thereof have not been illustrated. However, according to another aspect of the invention, musical breaks initiated during such introduction and ending portions of a composition are ignored and not played.

Figure 2:
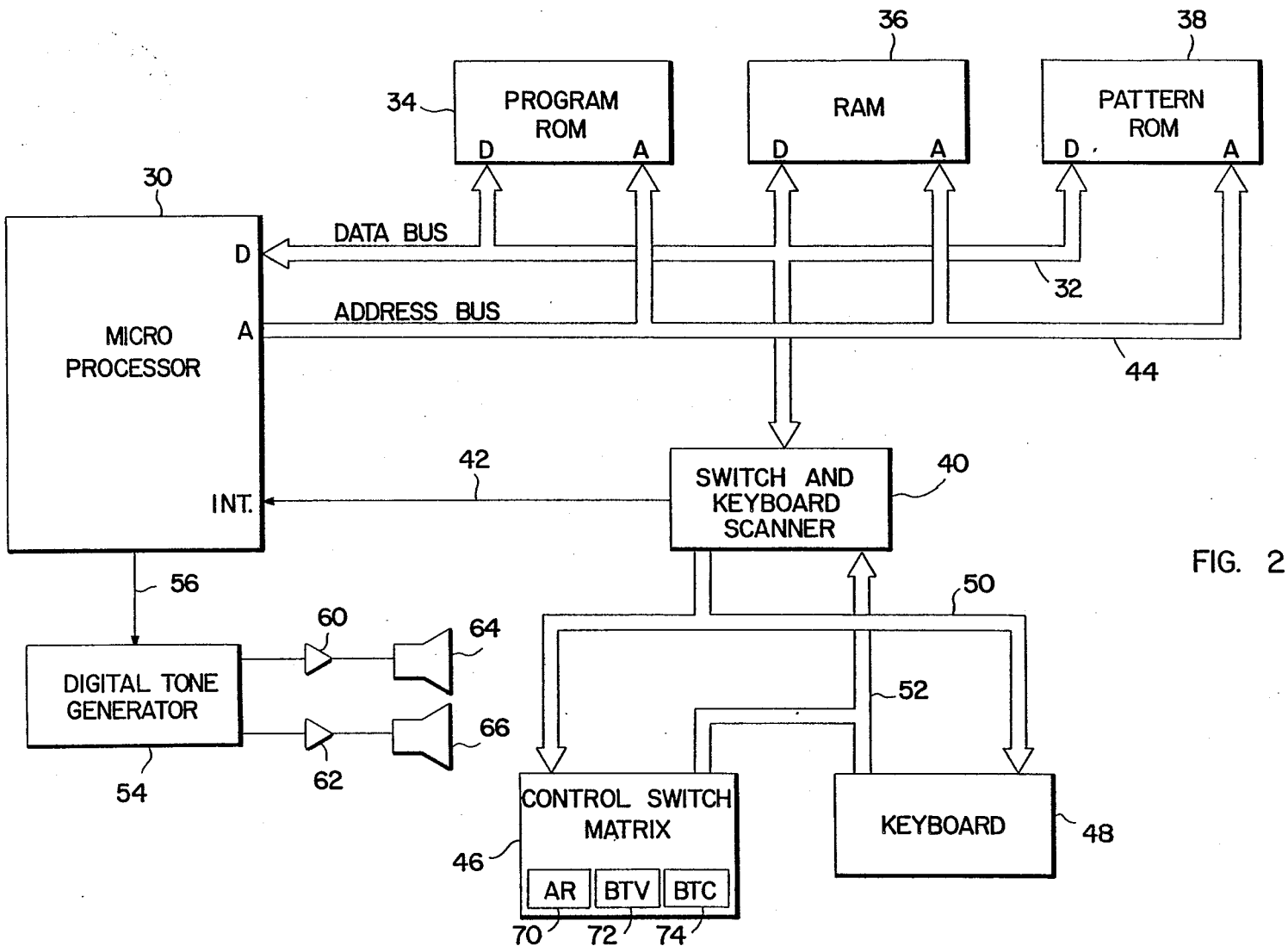
FIG. 2 is a simplified block diagram illustrating an electronic keyboard musical instrument embodying the present invention.

FIG. 2 is a block diagram illustrating an electronic keyboard musical instrument embodying the present invention. The musical instrument is controlled by a microprocessor 30 which is connected by a bi-directional data bus 32 to a program ROM 34, a RAM 36 and a pattern ROM 38. Data bus 32 also couples microprocessor 30 to a switch and keyboard scanner 40 which has an output 42 connected to an interrupt input of microprocessor 30. Microprocessor 30 addresses program ROM 34, RAM 36 and pattern ROM 38 via an address bus 44.

Switch and keyboard scanner 40 is responsive to inputs received over data bus 32 for generating scanning signals on a bus 50. These scanning signals are used to scan the switches and keys of a control switch matrix 46 and a keyboard 48. Control signals identifying switch and key closures are coupled back to scanner 40 on a bus 52. Scanner 40 interrupts microprocessor 30 over line 42 and control signals identifying switch and key closures are applied to the microprocessor over data bus 32. Microprocessor 30, in response to switch and key closure control signals from switch matrix 46 and keyboard 48, suitably interacts with memories 34-38 over data and address buses 32 and 44 to formulate a digital representation of a desired musical performance. The techniques and methods for formulating this digital representation are well known in the art and therefore will not be described in detail herein. Suffice it to say that the digital signals representing the musical performance are applied by microprocessor 30 to a digital tone generator 54 over a serial interface line 56. Digital tone generator 54 is a well known circuit for transforming the digital signals from microprocessor 30 into analog signals capable of producing the desired musical performance. In particular, the analog signals from tone generator 54 are amplified by a pair of amplifiers 60 and 62 and then applied to a pair of speakers 64 and 66 for acoustically producing the musical performance.

Figure 3:
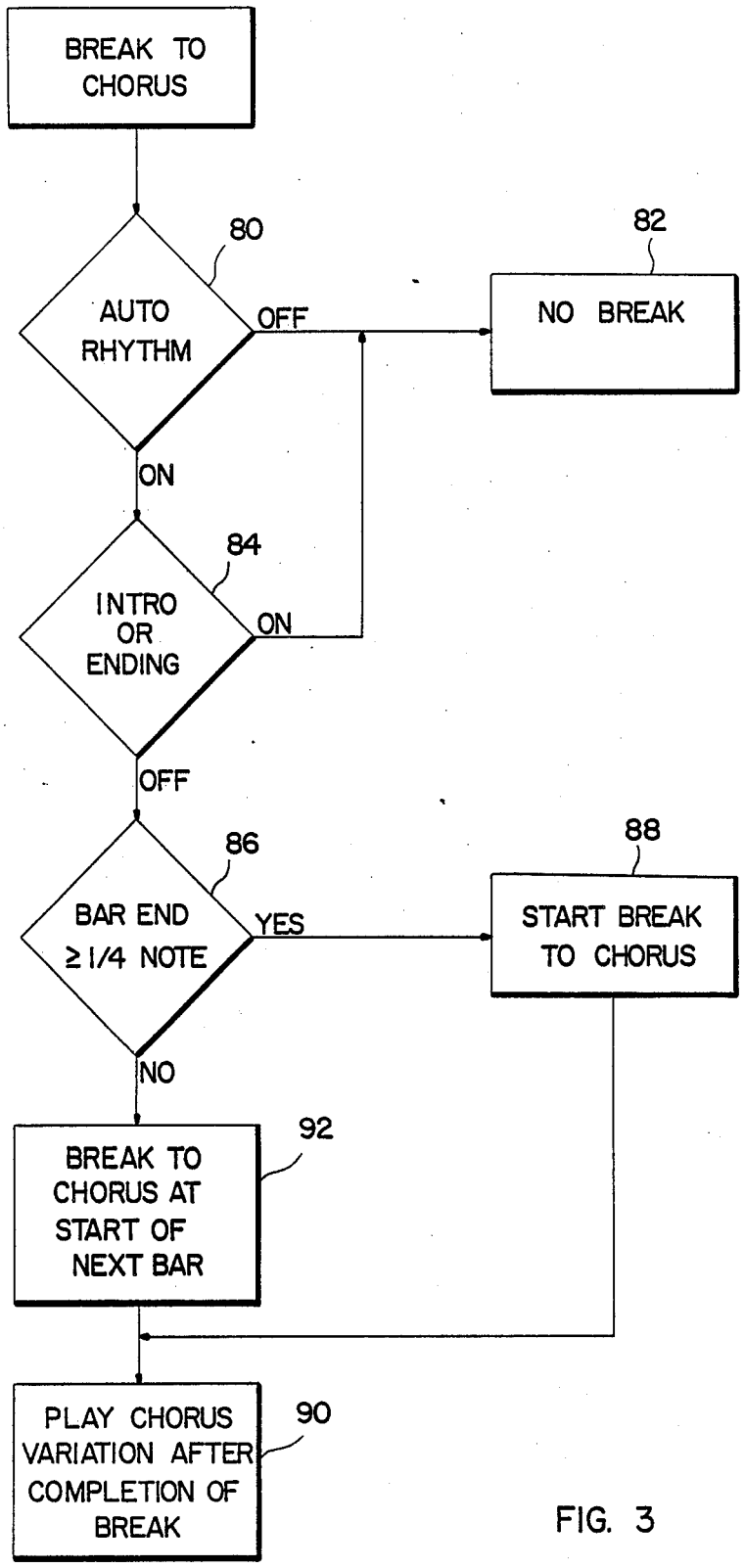
FIGS. 3 and 4 are flow charts illustrating the method of programming the electronic musical instrument of FIG. 2 in accordance with the present invention.
Figure 4:
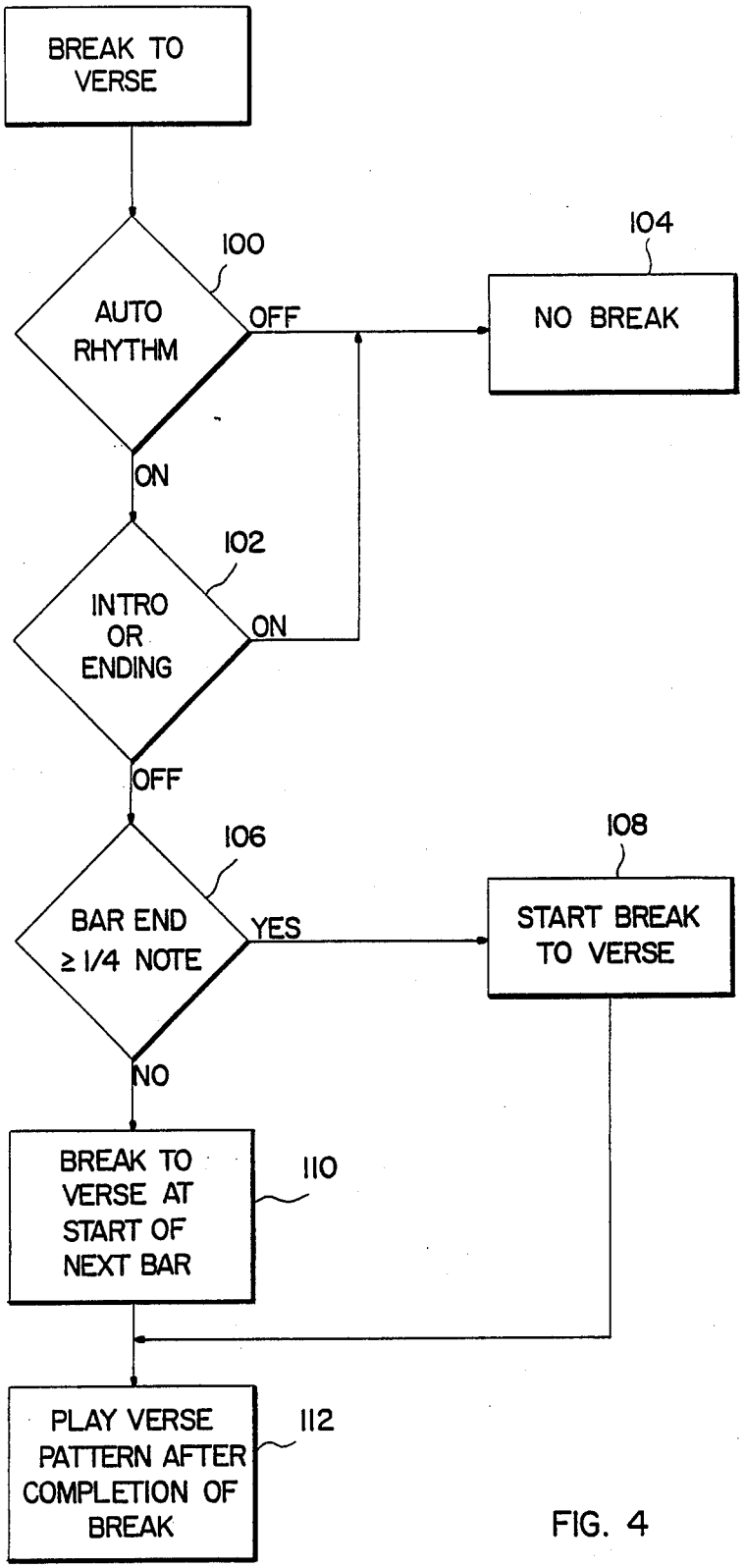

In accordance with the invention, program ROM 34 includes a first subroutine entitled "break to chorus" as illustrated in FIG. 3 and a second subroutine entitled "break to verse" as illustrated in FIG. 4. Pattern ROM 38 includes a plurality of sections of memory locations each storing a respective one of the accompaniment and break patterns illustrated in FIG. 1. As previously described, each pattern type may include a group of stored patterns which are selected for playing in a desired manner in accordance with the system program stored in ROM 34.

In operation, a performer initiates the playing of an automatic rhythm or accompaniment pattern by closing a switch 70 labeled "AR" on control switch matrix 46. The closure of this switch is communicated to microprocessor 30 by a control signal from scanner 40. In response thereto, microprocessor 30 in conjunction with the system program stored in ROM 34, reads selected accompaniment patterns from pattern ROM 38 and applies the patterns to tone generator 54 where they are converted to appropriate analog signals capable of being acoustically reproduced by speakers 64 and 66. It will be understood that the accompaniment patterns read from pattern ROM 38 may be temporarily stored in RAM 36 before being applied to tone generator 54 by microprocessor 30.

Control switch matrix 46 includes two additional switches, a switch 72 labeled "BTV" (break to verse) and a switch 74 labeled "BTC" (break to chorus). Closure of either of these two switches causes microprocessor 30 to branch to the corresponding subroutine shown in either FIG. 3 or 4 for executing the break features of the invention.

For example, assume that an automatic accompaniment pattern is being played as illustrated by time line 10 of FIG. 1. At some time corresponding to points 14, 20 or 22, the performer closes switch 74 to initiate a "break to chorus". This causes microprocessor 30 to execute the subroutine illustrated in FIG. 3. The first step in this subroutine is a decision 80 to determine whether the automatic rhythm feature is on or off. If the automatic rhythm function is off, the break pattern is not played as represented by block 82. Since, however, the automatic rhythm function is on, the subroutine continues to a second decision 84 to determine whether the introduction or ending of the accompaniment pattern is being played. If either are in progress, the break is again not executed in accordance with block 82. Assuming that neither the introduction nor ending is in progress, the subroutine proceeds to decision block 86. At this time, a decision is made regarding whether BTC switch 74 was operated within ¼ of the end of the bar. In the cases of both points 14 and 20 of the accompaniment pattern of FIG. 1, the breaks were initiated before the last ¼ of the respective bar leading the subroutine to begin playing the chorus break pattern substantially immediately. Thus, a selected chorus break pattern is read from pattern ROM 38 and played until the end of the bar. Upon completion of the chorus break pattern, the subroutine executes block 90 calling for the playing of a chorus accompaniment variation.

In the case of point 20, BTC switch 74 was operated within the last ¼ of the bar. The subroutine therefore proceeds from decision 86 to block 92 which causes the chorus break pattern to be delayed until the downbeat of the next bar (i.e. point 24 in FIG. 1). As before, the chorus accompaniment variation is played in accordance with instruction 90 upon completion of the chorus break pattern. It will be observed that in the cases of the breaks initiated at points 14 and 20, the chorus break patterns served as transitions between a verse accompaniment pattern and a chorus accompaniment pattern while, in the case of the break initiated at point 22 (but not actually begun until point 24), the chorus break pattern formed a transition between two chorus accompaniment patterns.

Operation of BTV switch 72 is very similar to that of BTC switch 74. For example, operating BTV switch 72 at points 16 and 18 of the accompaniment pattern illustrated in FIG. 1 causes causes microprocessor 30 to execute the break to verse subroutine stored in program ROM 34 and illustrated by the flowchart of FIG. 4. The subroutine illustrated in this flowchart is substantially identical to the break to chorus subroutine illustrated in FIG. 3. Thus, the status of AR switch 70 is checked at a decision 100 and a determination is made at decision 102 as to whether the introduction or ending of the accompaniment pattern is in progress. As before, as represented by block 104, a break pattern will not be played if either the AR switch is off or an introduction or ending is in progress.

Next, a decision is made at 106 regarding the relative timing of the break which is then either started substantially immediately per block 108 or is delayed until the beginning of the next bar per block 110. Finally, following completion of the verse break pattern, the subroutine proceeds to play a verse accompaniment pattern as indicated at block 112. It will be observed that the verse break pattern initiated at point 16 formed a musical transition between a chorus accompaniment pattern and a verse accompaniment pattern while the verse break pattern initiated at point 18 formed a transition between two verse accompaniment patterns.

With the invention, a much improved method of inserting beak patterns in an automatic accompaniment arrangement is made available. It is recognized that numerous changes and modifications in the described embodiment of the invention may be made without departure from its true spirit and scope. The invention is therefore to be limited only as defined in the claims appended hereto.

What is claimed is:

1. An electronic musical instrument comprising:

memory means including a plurality of memory sections respectively storing a verse accompaniment pattern, a chorus accompaniment pattern, a verse break pattern and a chorus break pattern;

first and second switch means operable by a performer for respectively generating first and second control signals; and control means coupled to said memory means for playing said verse and chorus accompaniment patterns and responsive to said first control signal for interrupting the playing of said verse or chorus accompaniment patterns with the playing of said chorus break pattern and thereafter automatically resuming playing of said chorus accompaniment pattern and responsive to said second control signal for interrupting the playing of said verse or chorus accompaniment patterns with the playing of said verse break pattern and thereafter automatically resuming playing of said verse accompaniment pattern.

2. The musical instrument of claim 1 wherein said automatic accompaniment pattern comprises a plurality of musical bars and wherein said control means is responsive to said first and second control signals for substantially immediately playing said chorus and verse break patterns only when said first and second switch means are operated prior to a predetermined interval from the end of one of said bars.

3. The musical instrument of claim 2 wherein said predetermined interval comprises ¼ of a musical bar.

4. The musical instrument of claim 2 wherein said control means is responsive to the operation of said first or second switch means within said predetermined interval for respectively playing said chorus and verse break patterns substantially coincidentally with the beginning of the next successive musical bar.

5. The musical instrument of claim 1 wherein said memory means includes respective memory sections storing an introduction portion and an ending portion and including means for inhibiting the operation of said control means for playing said break patterns during the playing of said introduction and ending portions.

6. An electronic musical instrument comprising:

memory means including a plurality of memory sections respectively storing first and second different break patterns and first and second different portions of an automatic accompaniment pattern, the first and second portions corresponding respectively to different sections of a musical performance;

first switch means operable by a performer for generating a first control signal;

second switch means operable by a performer for generating a second control signal; and control means coupled to said memory means for playing said stored portions of said automatic accompaniment pattern, said control means being responsive to said first control signal for interrupting the playing of said first portion with the playing of said first break pattern and thereafter automatically resuming the playing of said second portion and responsive to said second control signal for interrupting the playing of said second portion with the playing of said second break pattern and thereafter automatically resuming the playing of said first portion.

* * * * *